US012305400B2

(12) United States Patent
Hollaar et al.

(10) Patent No.: US 12,305,400 B2
(45) Date of Patent: May 20, 2025

(54) BUILDING PANEL AND COUPLING SYSTEM FOR SUCH BUILDING PANELS

(71) Applicant: WEST.NEDER.LAND. SANDWICH PANELEN B.V., Hoek van Holland (NL)

(72) Inventors: Gerrit Jan Hollaar, Hoek van Holland (NL); Michiel Van De Groenendaal, Hoek van Holland (NL)

(73) Assignee: WEST.NEDER.LAND. SANDWICH PANELEN B.V., Hoek van Holland (NL)

( * ) Notice: Subject to any disclaimer, the term of this patent is extended or adjusted under 35 U.S.C. 154(b) by 225 days.

(21) Appl. No.: 17/996,383

(22) PCT Filed: Apr. 16, 2021

(86) PCT No.: PCT/NL2021/050246
§ 371 (c)(1),
(2) Date: Oct. 17, 2022

(87) PCT Pub. No.: WO2021/215910
PCT Pub. Date: Oct. 28, 2021

(65) Prior Publication Data

US 2023/0220672 A1 Jul. 13, 2023

(30) Foreign Application Priority Data

Apr. 20, 2020 (NL) ..... 2025373

(51) Int. Cl.
*E04C 2/292* (2006.01)
*E04D 3/35* (2006.01)

(52) U.S. Cl.
CPC ..... *E04D 3/355* (2013.01); *E04D 3/352* (2013.01); *E04D 3/358* (2013.01); *E04C 2/292* (2013.01)

(58) Field of Classification Search
CPC ..... E04C 2/292; E04D 3/352; E04D 3/35; E04D 3/351; E04D 3/354; E04D 3/355;
(Continued)

(56) References Cited

U.S. PATENT DOCUMENTS 3,667,180 A * 6/1972 Tischuk ..... E04F 13/0803 52/592.4
3,828,493 A * 8/1974 Vezmar ..... F16B 5/0258 411/391
(Continued)

FOREIGN PATENT DOCUMENTS

DE 8803615 U1 6/1988
DE 102007020494 A1 11/2008
(Continued)

OTHER PUBLICATIONS

International Search Report and Written Opinion for corresponding International application No. PCT/NL2021/050246; dated Jul. 6, 2021 (14 pages).
(Continued)

*Primary Examiner* — Kyle J. Walraed-Sullivan

(57) ABSTRACT

Coupling system (3, 30) for coupling building panels (1, 2; 31, 32) or sandwich panel comprising two cover sheets (5, 6; 33, 34, 36, 37) and a core (4, 39) of insulating material sandwiched between the two cover sheets, in particular for building a roof structure. The building panels have matching coupling edges (7, 8; 40, 41), profiled to define one or more water discharge channels (19; 59, 64) running substantially parallel to the coupling edges.

4 Claims, 5 Drawing Sheets

(58) Field of Classification Search

Figure 1:
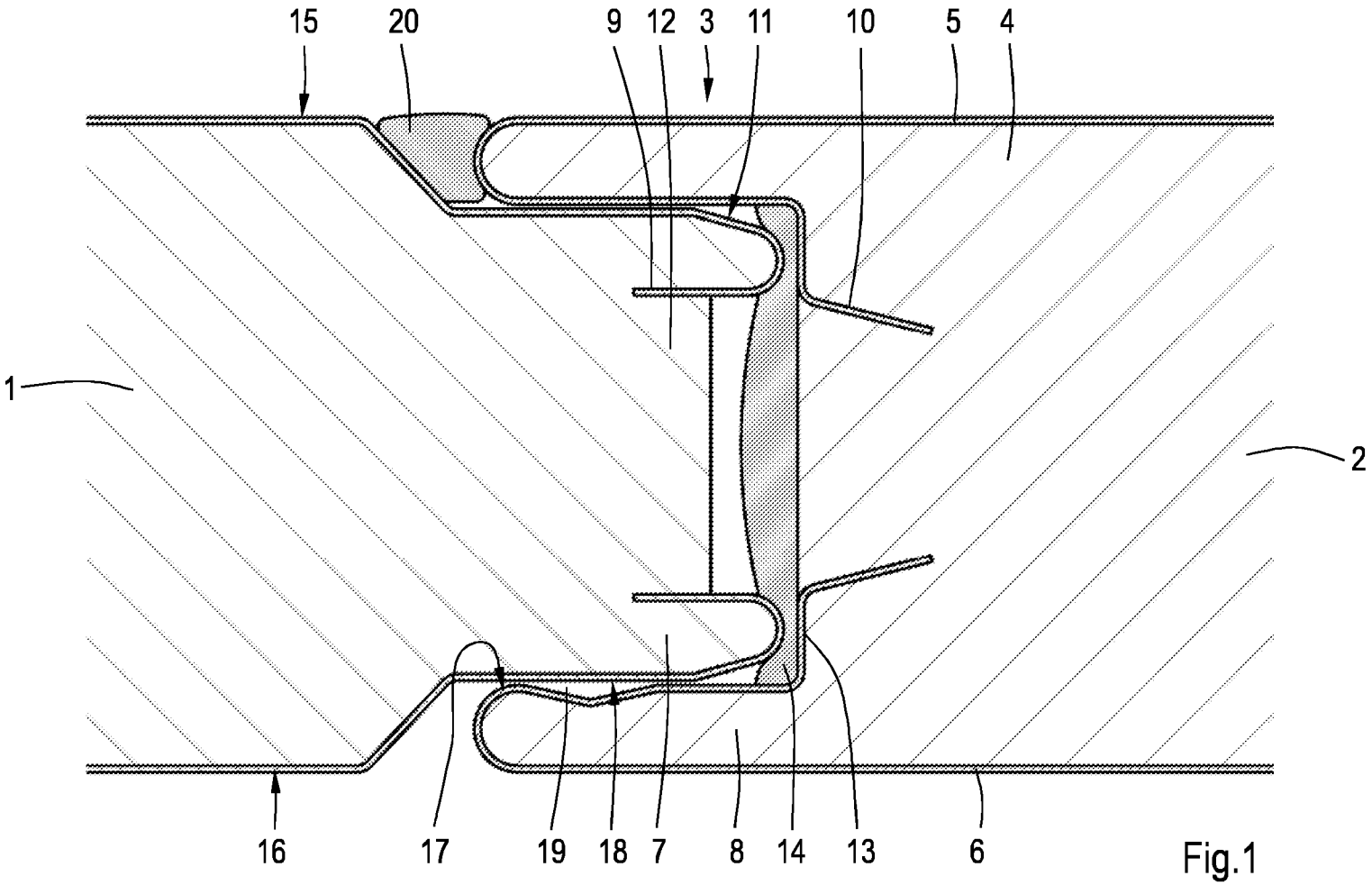

CPC ..... E04D 3/357; E04D 3/3603; E04D 3/362; E04D 3/363; E04D 2003/3615; E04D 13/0445; E04D 13/0447; E04D 13/0866; E04D 13/0869; E04F 13/076; E04F 13/077; E04F 13/0889; E04F 13/0892; E04F 13/0894; E04F 15/02038; E04B 1/6108; E04B 1/612; E04B 1/6125; E04B 1/6166; E04B 1/617; E04B 1/6175; E04B 1/6179; E04B 2002/0204; E04B 2002/0226; E04B 2002/0228; E04B 2002/0232

See application file for complete search history.

(56) References Cited

U.S. PATENT DOCUMENTS

| | | | | | |
|---|---|---|---|---|---|
| 4,037,377 | A * | 7/1977 | Howell | E04C 2/296 | 52/592.1 |
| 4,123,885 | A * | 11/1978 | Scott | E04F 13/12 | 52/489.1 |
| 4,177,615 | A * | 12/1979 | Anderson | E04D 3/352 | 52/394 |
| 4,184,301 | A * | 1/1980 | Anderson | E04B 1/6104 | 52/592.4 |
| 4,316,351 | A * | 2/1982 | Ting | E04C 2/292 | 52/592.4 |
| 4,700,520 | A * | 10/1987 | Ting | E04D 3/365 | 52/520 |
| 5,048,248 | A * | 9/1991 | Ting | E04C 2/292 | 52/459 |
| 5,216,861 | A * | 6/1993 | Meyerson | E04C 2/292 | 52/309.9 |
| 5,425,210 | A * | 6/1995 | Zafir | E04C 2/292 | 52/592.4 |
| 5,533,312 | A * | 7/1996 | Mihalcheon | E06B 3/827 | 52/800.1 |
| 5,613,338 | A | 3/1997 | Esposito | | |
| 2009/0025335 | A1* | 1/2009 | Flynn | E04D 3/355 | 52/794.1 |
| 2012/0231231 | A1* | 9/2012 | Curtin | E04C 2/292 | 428/192 |
| 2014/0053481 | A1* | 2/2014 | Leahy | E04B 1/34321 | 52/270 |
| 2018/0016786 | A1* | 1/2018 | Boyd | E04B 1/14 | |

FOREIGN PATENT DOCUMENTS

| | | | | | |
|---|---|---|---|---|---|
| DE | 102009025187 | A1 | | 12/2010 | |
| EP | 1152096 | A2 | * | 11/2001 | E04C 2/292 |
| EP | 1201843 | A2 | | 5/2002 | |
| EP | 1209297 | A1 | | 5/2002 | |
| EP | 1260647 | A1 | * | 11/2002 | E04C 2/292 |
| FR | 2731029 | A1 | | 8/1996 | |
| GB | 2325678 | A | * | 12/1998 | E04C 2/292 |
| GB | 2435058 | A | * | 8/2007 | E04C 2/292 |
| JP | 09279772 | A | * | 10/1997 | E04D 3/352 |
| JP | 2012-167431 | A | | 9/2012 | |

OTHER PUBLICATIONS

European Office Action based on corresponding European application No. 21720864.4; dated Dec. 5, 2024 (6 pages).

* cited by examiner

BUILDING PANEL AND COUPLING SYSTEM FOR SUCH BUILDING PANELS

The present disclosure relates to a coupling system for coupling sandwich building panels, the building panels comprising two cover sheets and a core of insulating material sandwiched between the two cover sheets. The disclosure also relates to building panels provided with such a coupling system, and to a building structure comprising such building panels, in particular a roof structure.

EP 1 209 297 discloses an example of such a building panel. Other examples are sandwich panels available from SAB-profiel BV, the Netherlands, such as the SAB WB and SAB W panels. These sandwich panels are designed as wall panels, with the coupling edges extending vertically. If such building panels are used for roofing, the coupling edges are horizontal or inclined and exposed to ingress of rain water. Therefore, the joints must be sealed to prevent leaking of rainwater or melting snow. Usually, one or two parallel seals are applied, extending along the full length of the joint. This requires large amounts of sealing compound. One sealing must be applied before mounting and one after placing of the roofing, so the job is labour-intensive. Sealing compounds must be applied under favourable weather conditions, which means that it must not be too cold or rainy. Even dew can limit daily mounting hours for application of the sealing compounds.

It is an object of the invention to provide building panels which are more suitable for use in a non-vertical position, in particular for building a roof which is less sensitive for water leakage.

The object of the invention is achieved with a coupling system for coupling building panels, the building panels having matching coupling edges, profiled to form one or more water discharge channels running substantially parallel to the coupling edges.

Rather than trying to fully block any leakage of water, the water discharge channel discharges water seeping between the coupling edges. By coupling the building panels, the coupling edges enclose the water discharge channel, viewed in cross section. When mounted, building panels of roofing structure are typically inclined and mounted side by side, so the coupled edges are also inclined. Hence, water collected in the water discharge channel flows down to an open lower end of the discharge channel where the water can be collected, e.g., in a gutter. The top end of the water discharge channel can be capped, e.g., by a ridge, and/or sealed to avoid direct ingress of rain water.

The cover sheets typically include an inner cover sheet and an outer cover sheet. The outer cover sheet is configured for outdoor conditions, e.g., the outer cover sheet may for example be thicker than the inner cover sheet and/or be provided with a weather resistant coating, while the inner cover sheet is configured for indoor conditions. The cover sheets are typically parallel and aligned to form building panels of substantially even thickness which can be coupled to form a substantially flush surface.

Optionally, the coupling system comprises one or more compressible seals between the coupling edges at a position between the water discharge channel and the outer cover sheets. As a result, the main part of the rain water will be blocked by the seal and will flow from the roof, while the water discharge channel or channels are needed only for the discharge of water seeping through the seal. Combining a seal with a water discharge channels facilitates efficient management of water.

At the coupling edges of the building panel, the cover sheets may for example have bent sheet edges piercing into the insulating material. This way, sharp edges of the sheets are shielded by the insulating material. It also serves to avoid any thermal bridges between the inner and outer cover sheets. Moreover, such bent edges provide resiliency during coupling and improve the clamping fit between two coupled coupling edges.

With such building panels having inwardly bent and shielded cover sheet edges, the coupling edge of one of the building panels can be a female coupling edge recessed between the two bent sheet edges, while the coupling edge of the other building panel can be a matching male coupling edge with the bent edges being offset from the outer surfaces of the panel, so as to form a projection fitting within the recess of the female coupling edge. The male and/or female coupling edge can be provided with a recess for forming the water discharge channel extending substantially parallel to the coupling edges.

Optionally, the female coupling edge is offset from an exterior surface of the building panel, while the male coupling edge comprises a flange extending the outer surface of the building panel, and overlapping the female coupling edge. The flange of the male coupling edge can for example be received in a recess, so as to be flush with the outer surface of the building panel with the female coupling edge. The flange can be such that it overlaps the water discharge channel. Optionally, the overlapped water discharge channel can be configured to receive a fastener in a sunk manner, e.g., a fastener serving to bolt the panel to a roof support. This way, the water discharge channel and the fasteners are hidden from view, and the roof has a smooth appearance, allowing rain water and snow top slide off the roof without obstacles.

In a specific embodiment the overlapping flange may have a stepped cross section with an outer tip of reduced thickness and a main part of increased thickness, the main part overlapping the water discharge channel, the outer tip matching a recess in the female coupling edge and overlapping the compressible seal. The compressible seal can for example be partly received in a matching recess.

The compressible seal can be any suitable type of seal, including but not limited to hollow strips or hoses, e.g., of a rubber or elastomeric material.

Optionally, an additional compressible sealing strip can be compressed by a transversal surface bridging the outer tip and the main part of the overlapping flange of the male coupling edge.

An alternative, or additional, water discharge channel can be formed in one or more recesses used for coupling the building panels. For example, the bent sheet edges of the female coupling edge can be received in respective matching recesses in the male coupling edge, one or both of the recesses being extended to form a water discharge channel. The recess with the water discharge channel can for example be adjacent the overlapping flange of the male coupling edge.

The insulating material of the building panels can for example comprise polyisocyanurate (PIR), polyurethane (PUR) or any other suitable insulating material. The cover sheets are typically sheets of a suitable coated steel, e.g., of about 0.5-1 mm thickness. Other materials, such as aluminium and/or other thicknesses can also be used of so desired.

The coupling system can be realized using building panels comprising at least one male and/or female coupling edge of the coupling system of any one of the preceding claims. In a specific embodiment the building panel comprises a male coupling edge at one side and a female coupling edge at an opposite side of the building panel.

The building panels of the present disclosure can be used for building a structure, in particular a roof structure comprising coupled building panels, in particular to a roof with building panels mounted side by side on a roof support, e.g., with the coupling edges being inclined extending from one or both side of a roof ridge to respective lower edges. The lower edges of the roof structure may be provided with a gutter. The upper and lower edges of the building panels can be covered to protect the insulating layer or for decorative reasons.

The above-described aspects will hereafter be more explained with further details and benefits with reference to the drawings showing a number of embodiments by way of example.

Figure 2:
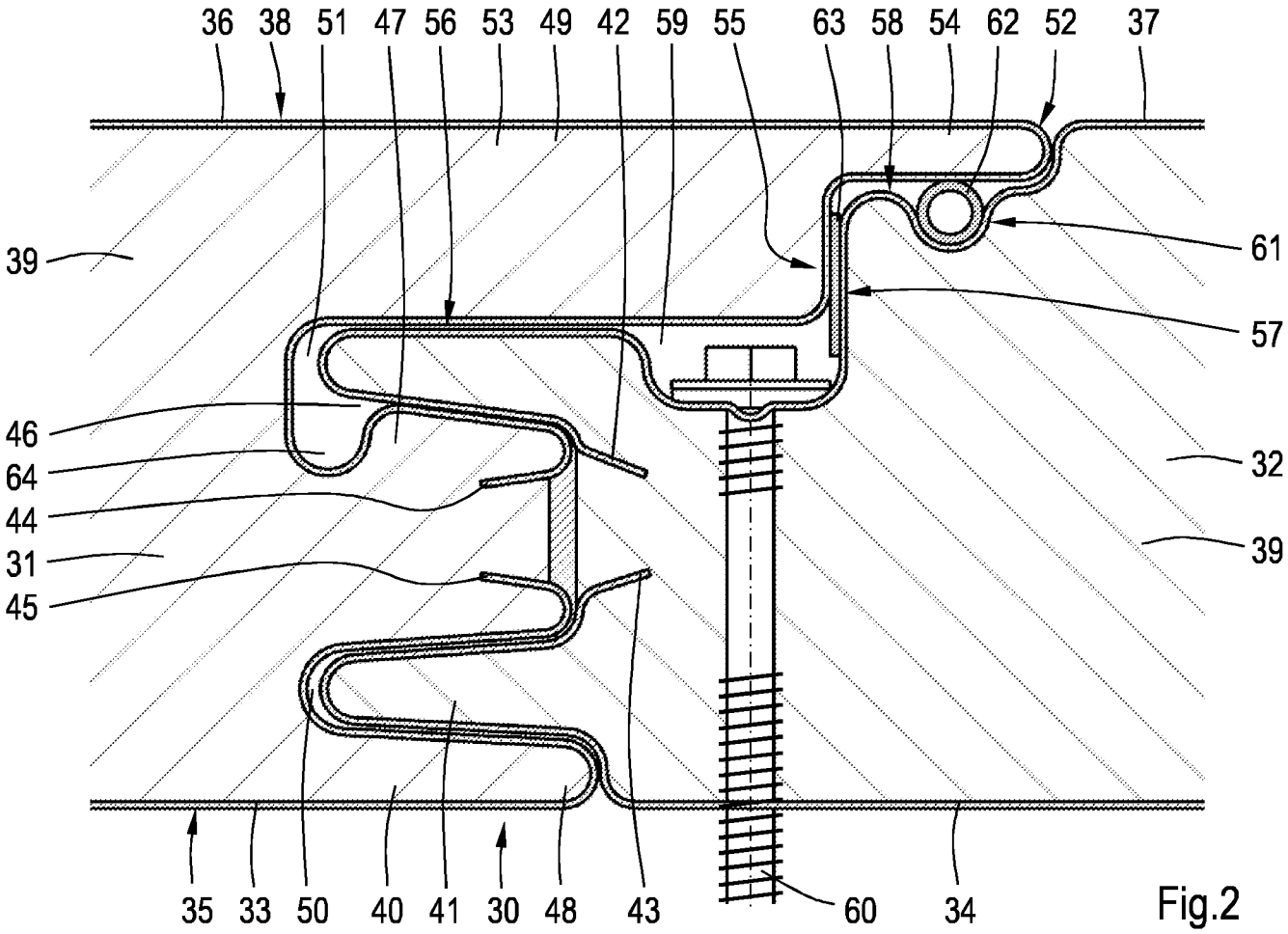
Figure 3:
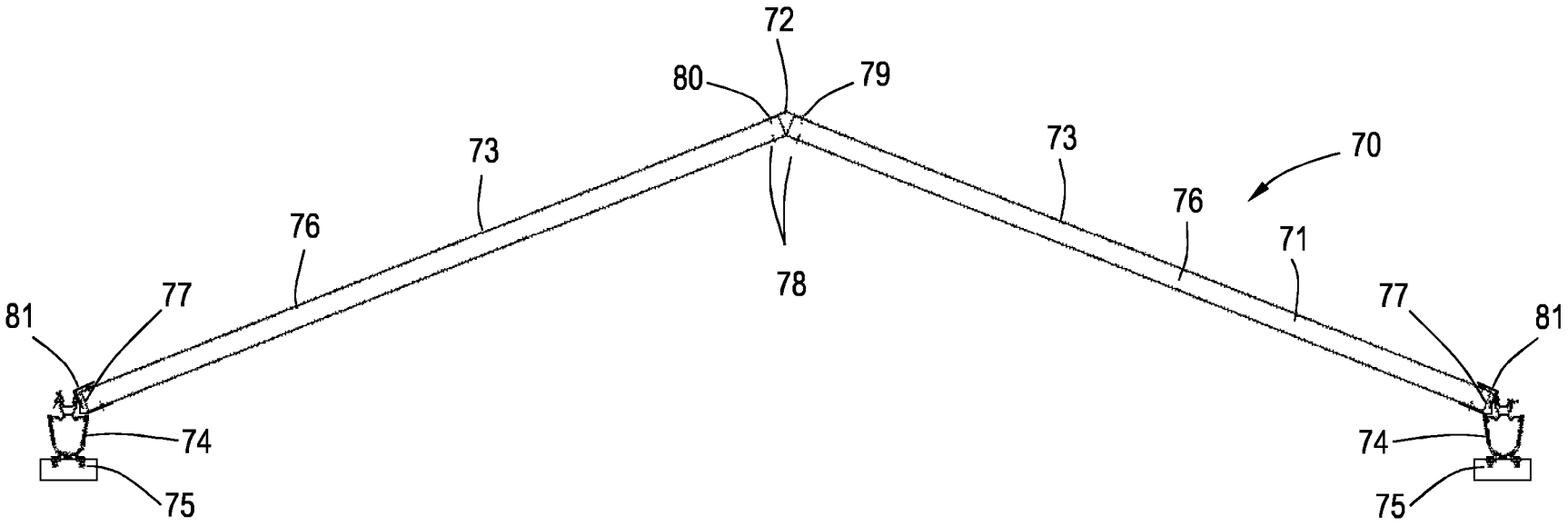
Figure 4A:
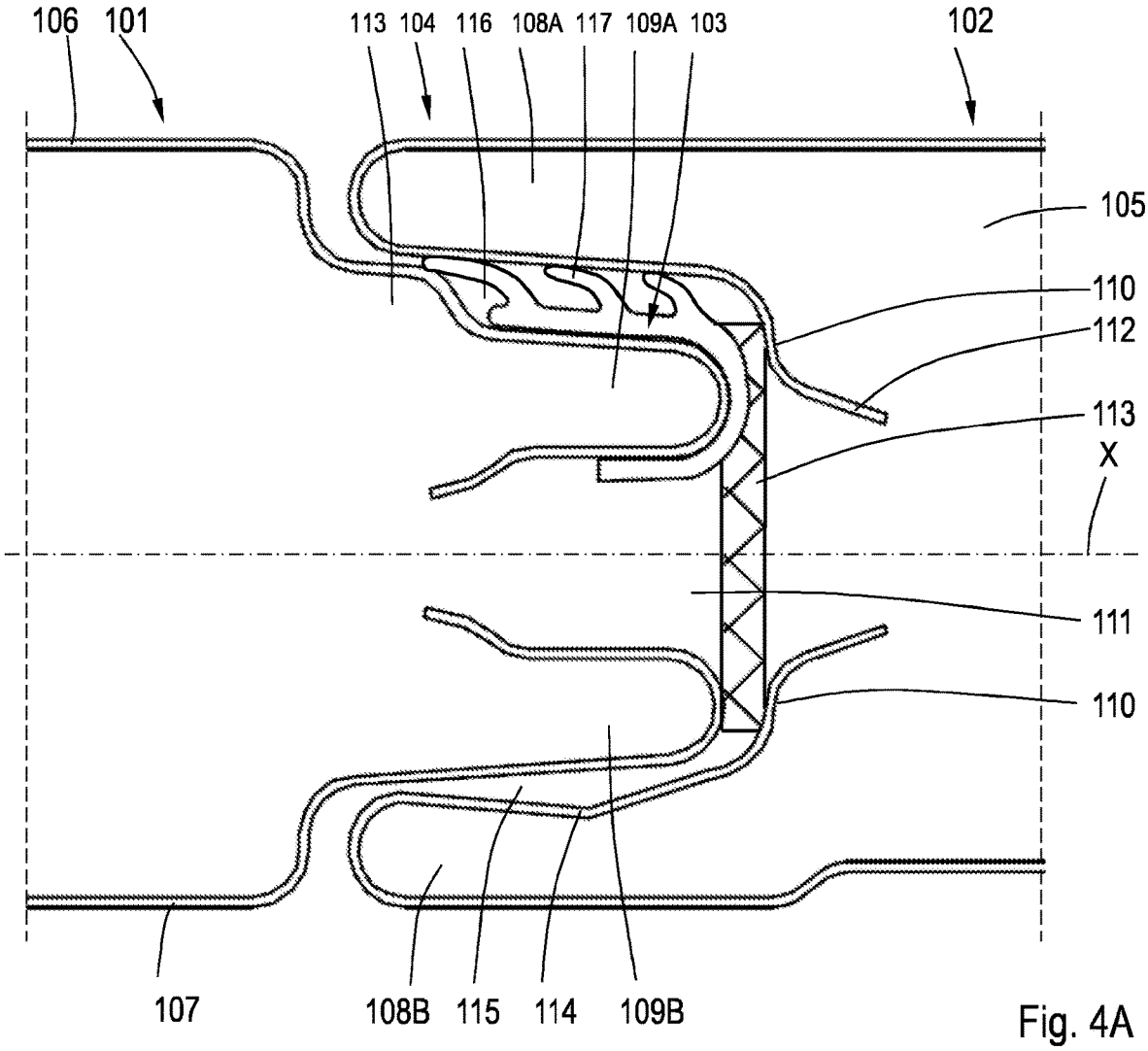
Figure 4B:
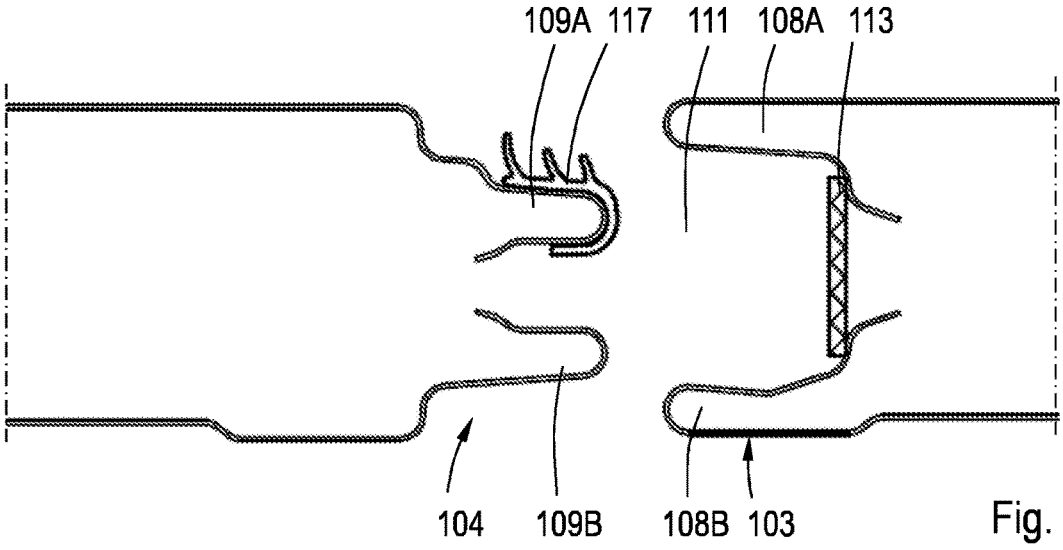
Figure 5A:
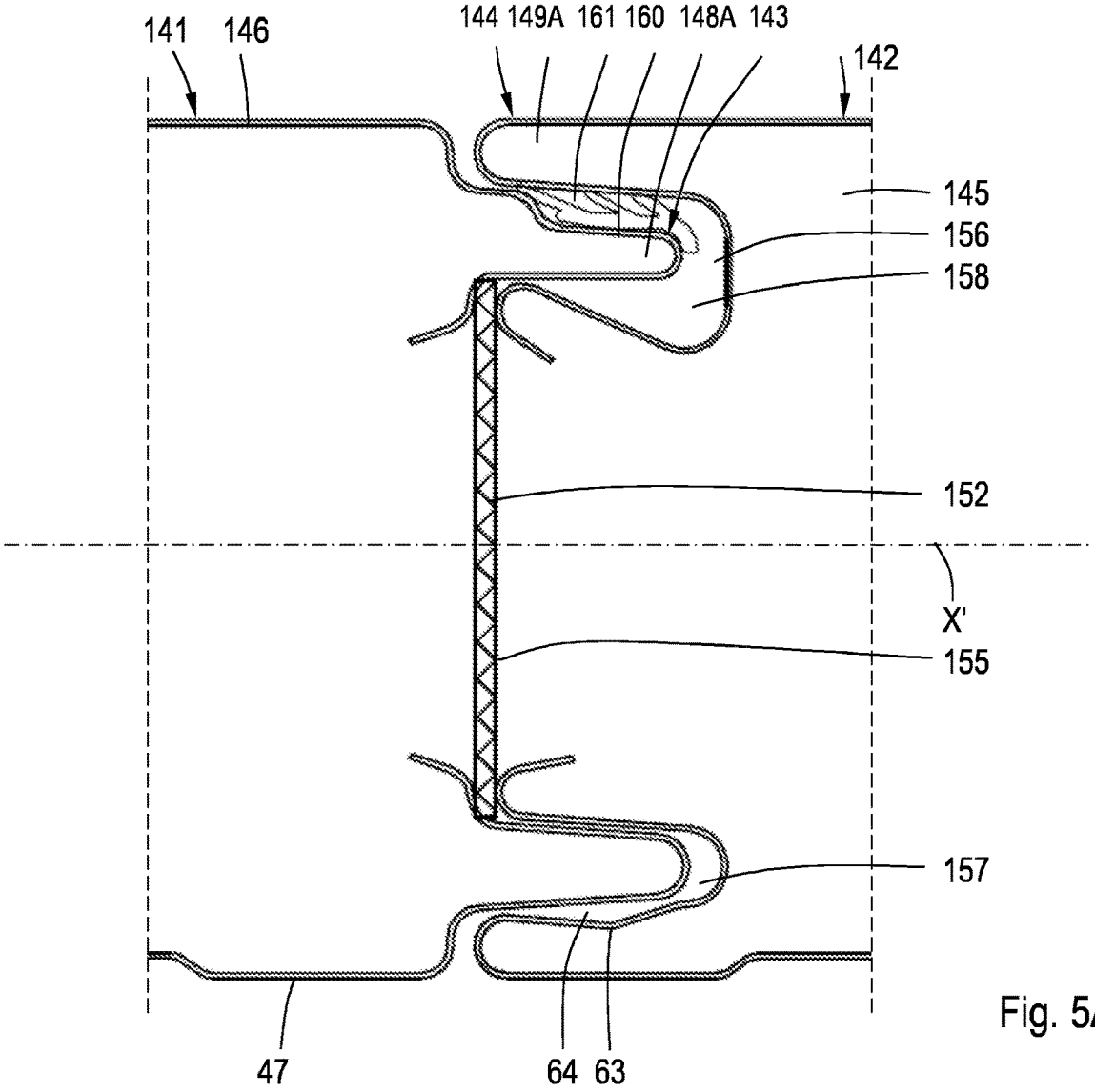
Figure 5B:
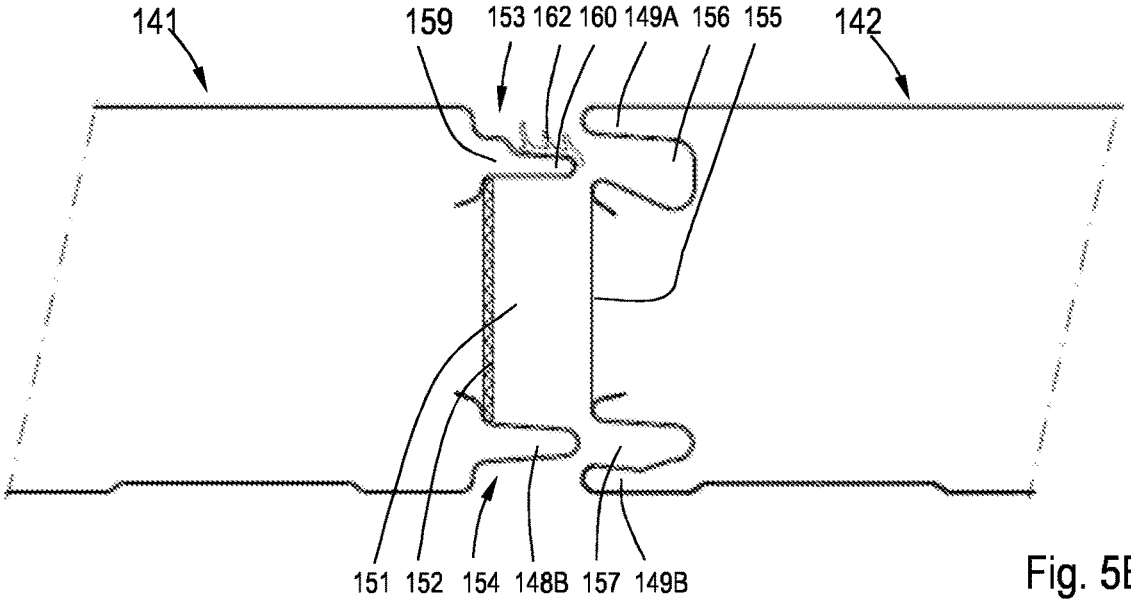

FIG. 1: shows in cross section a coupling system according to the present invention;

FIG. 2: shows in cross section an alternative coupling system according to the present invention;

FIG. 3: shows a roof structure;

FIG. 4A: shows a third embodiment;

FIG. 4B: shows the panels of FIG. 1A before coupling;

FIG. 5A: shows a fourth embodiment;

FIG. 5B: shows the panels of FIG. 5A after coupling.

FIG. 1 shows a cross section of two building panels 1, 2 coupled by a coupling system 3, e.g., to form a roof. The two building panels 1, 2 comprise a core 4 of an insulating material, e.g., a PIR foam, sandwiched between two cover sheets, for example of a coated steel, i.e., an outer cover sheet 5 forming the exterior roof surface, and an inner cover sheet 6 facing the roofed interior space.

The building panels 1, 2, have matching coupling edges 7, 8. The cover sheets 5, 6 of both building panels 1, 2 have sheet edges 9, 10 at the coupling edges 7, 8, which are bent and pierce into the insulating core 4. One of the coupling edges is a female coupling edge 8 with a coupling recess 11 between its two bent sheet edges 10. The coupling edge of the other building panel 1 is a male coupling edge 7 with the bent sheet edges 9 being offset from the outer surfaces of the building panel 1, so as to form a coupling projection 12 narrowly fitting and clamping within the coupling recess 11 of the female coupling edge 8. The bent sheet edges 10 of the female coupling edge 8 are bent to form a stop 13 for the bent sheet edges 9 of the male coupling edge 7.

A compressible seal 14 is provided between the bent sheet edges 9 of the male coupling edge 7 and the stops 13 of the female coupling edge 8.

The building panels 1, 2 have an exterior side 15 configured for exposure to outdoor conditions, and an interior side 16. The bent sheet edge 10 at the interior side 16 of the female coupling edge 8 has one side face 17 adjacent a side face 18 of the bent sheet edge 9 at the interior side 16 of the male coupling edge 7. This side face 17 is dented, so the adjacent side faces 17, 18 jointly enclose a water discharge channel 19 running substantially parallel to the coupling edges 7, 8, i.e., in a direction perpendicular to the drawing.

At the outer side 15 the joint between the two coupling edges 7, 8 is sealed by a sealant 20. Rain water seeping into the joint past the sealant 20 will mainly be blocked by the compressible seal 14. Water passing this seal 14 will be collected in the water discharge channel 19.

FIG. 2 shows an alternative embodiment of a coupling system 30 according to the invention. As in the embodiment of FIG. 1, the coupling system couples two building panels 31, 32, both comprising an interior cover sheet 33, 34 at an interior side 35, an outer cover sheet 36, 37 at an exterior side 38, and a core 39 of an insulating material, such as PIR or PUR, sandwiched between the inner and outer cover sheets 33, 36; 34, 37.

The building panels 31, 32 having matching coupling edges 40, 41. The cover sheets 33, 36; 34, 37 have bent sheet edges 42, 43, 44, 45 at the coupling edges 40, 41. The bent sheet edges 42, 43, 44, 45 pierce into the insulating material of the core 39 of the respective building panel 31, 32.

The coupling edge 41 of one of the building panels 32 is a female coupling edge with a coupling recess 46 between the two bent sheet edges 42, 43. The coupling edge 40 of the other building panel 31 is a male coupling edge with the bent sheet edges 44, 45 being offset from the interior and exterior surfaces 35, 38 of the building panel 31, so as to form a coupling projection 47 fitting within the coupling recess 46 of the female coupling edge 41. In this embodiment, the coupling projection 47 of the male coupling edge 40 is flanked by a smaller flange 48 at the interior side 35 of the building panel 31 and a larger flange 49 at the exterior side 38 of the building panel 31. Between the smaller flange 48 and the coupling projection 47 is a first recess 50 receiving a bent sheet edge 43 of the female coupling edge 41. Similarly, between the larger flange 49 and the coupling projection 47 is a second recess 51 receiving a bent sheet edge 42 of the female coupling edge 41. The short flange 48 is flush with the outer surface of the interior side 35 of the two building panels 31, 32, while the larger flange 49 is flush with the outer surface of the exterior side 38 of the two building panels 31, 32.

The female coupling edge 41 is offset from the exterior surface 38 of the building panel 32 to form a recess 52 receiving the larger flange 49 of the male coupling edge 40.

The larger flange 49 of the male coupling edge 40 and the matching recess 52 of the female coupling edge 41 have a matching stepped configuration. Hence, the larger flange 49 has a main part 53 and an outer tip 54 of reduced thickness. At the exterior side 38 of the flange 49, the tip 54 is flush with the main part 53 and the outer surface of the remainder of the building panel 31. At the opposite side of the flange 49, a transversal face 55 closes the outline between the tip 54 and the main part 53. Similarly, the matching recess 52 has a first surface 56 facing the main part 53 of the flange 49, a second surface 57 facing the transversal surface 55 of the flange 49, and a third surface 58 facing the outer tip 54.

This first surface 56 is provided with a water discharge channel 59 running substantially parallel to the coupling edges 40, 41, i.e., in a direction perpendicular to the drawing. The main part 53 of the larger flange 49 of the male coupling edge 40 overlaps the water discharge channel 59, thus closing the water discharge channel 59 in cross section.

The overlapped water discharge channel 59 is configured to receive the bolting heads of one or more fasteners 60 in a sunk manner. The fasteners 60 serve to mount the building panel 32 to a roof support. The overlapping flange 49 of the male coupling edge 40 hides the fasteners 60 from view.

The third surface 58 overlapped by the outer tip 54 of the flange 49 has a slot 61 receiving a compressible seal 62, formed by a rubber or rubber-like hose. The seal 62 and the slot 61 run substantially parallel to the coupling edges 40, 41. This seal 62 is between the water discharge channel 59 and the exterior surface 38 of the building panels 31, 32.

Between the transversal face 55 of the male coupling edge 40 and the second face 57 of the female coupling edge 41 is a compressible seal 63.

A second water discharge channel 64 is formed by a slot in the recess 51 between the larger flange 49 and the coupling projection 47 of the male coupling edge 40.

The building panels 31, 32 can be identical, having a male coupling edge 40 at one side and a female coupling edge 41 at the opposite side, so they can be mounted side by side.

Rain water falling upon the roof may seep into the joint between the two building panels 31, 32. This water will mainly be stopped by the first compressible seal 62. A minor portion of the water will pass the seal 62 and will be stopped by the seconds compressible seal 63. Water passing both seals 62, 63 is collected in the water discharge channel 59. Since this water discharge channel 59 is inclined, water will flow down to an open lower end of the water discharge channel 59 where it is collected, e.g., by means of a gutter. In the rare case that this water discharge channel 59 might overflow, the water will also be collected and discharged in the second water discharge channel 64.

FIG. 3 shows schematically a roof structure 70 comprising a roof 71 with a roof ridge 72 and inclined building panels 73, e.g., the building panels of FIG. 1 or 2 or any other type of building panels according to the invention. Each of the building panels 73 extend from the roof ridge 72 downwards to a gutter 74 on a support. The building panels 73 have oppositely arranged inclined coupling edges 76 and substantially horizontal upper and lower edges 77, 78. The upper edges 78 connect to the roof ridge 72 and are sealed off by a foam body 79 protecting the insulating cores and closing off the top ends of the water discharge channels of the respective coupling edges 76. The foam body 79 of the roof ridge 72 is capped by a flashing 80. The lower edges 77 of the building panels 73 are also covered by a matching profile 81 connecting the building panels 73 to the gutter 74.

FIGS. 4A and 4B show a pair of building panels, in particular roof panels 101, 102 with matching coupling edges 103, 104. The two panels 101, 102 comprise a core 105 of an insulating material sandwiched between an outer cover sheet 106 forming the exterior roof surface, and an inner cover sheet 107 facing the roofed interior space.

The coupling edge 103 of the panel 102 shown at the right side in the drawing is a female coupling edge, while the coupling edge 104 of the other panel 101 is a male coupling edge. The coupling edges 103, 104 are shown in cross section in FIGS. 4A and 4B. These cross sections are substantially constant over the length of the coupling edges 103, 104.

The cover sheets 106, 107 of both panels 101, 102 have sheet edges at the coupling edges 103, 104, which are bent inwardly (i.e., towards a center face X of the panels 101, 102) to form projections 108A, 108B, 109A, 109B extending substantially parallel to the outer surfaces of the cover sheets 106, 107 of the panels 101, 102. The bent sheet edges forming the projection 108A, 108*b* of the female coupling edge 103 have free ends 112 bent inwardly to form a shoulder 110 and then bent back to pierce into the insulating material 105.

The female coupling edge 103 of the panel 102 comprises the two projections 108A, 108B and a coupling recess 111 between the two projections 108A, 108B. The coupling recess 111 comprises a compressible foam backbone 113 between the two projections 108A, 108B and extending over the full length of the female coupling edge 103. The projections 108A, 108B are flush with the rest of the respective cover sheets 106, 107.

The male coupling edge 104 of the other panel 102 comprises the projections 109A, 109B which are offset from the outer surface of the panel 101 so as to fit tightly within the coupling recess 111 of the female coupling edge 103.

When the male coupling edge 104 is received in the female coupling edge 103, the outer cover sheets 107 of the two panels 101, 102 are flush with each other, just as the two inner cover sheets 106. The tips of the projections 109A, 109B of the male coupling edge 104 abut the shoulders 110 of the projections 108A, 108B in the coupling recess 111 of the female coupling edge 104.

In the coupling recess 111 of the female coupling edge 103, the projection 108A has a substantially flat surface. The projection 108B has a concave or kinked surface to form a concavity 114 facing the projection 108A. When the two coupling edges 103, 104 are mated, this concavity 114 and the projection 109B of the male coupling edge 104 jointly enclose a water discharge channel 115 running along the length of the coupling edges 103, 104.

The projection 109A extending from the outer cover sheet 106 of the male coupling edge 104 has a root section 113 and a receding tip 114. The root section 113 engages the tip of the projection 108A when mated while the receding tip 114 is spaced from the projection 108A of the female coupling edge 103. When mated, the receding tip 114 and the projection 108A jointly define a seal receiving recess 116. A seal 117 is received in the seal receiving recess 116. The projection 108A is slightly thinner than similar projections of the regular 40 mm sandwich building panels, in order to provide space for the seal 117.

The seal 117 and the water discharge channel 113 jointly provide a substantially leak tight coupling of the two panels 101, 102. Rain water or melting snow seeping into the coupling is mainly blocked by the seal 117. Water that still passes the seal 117 is collected and discharged in the water discharge channel 115.

When the panels 101, 102 are coupled and the male coupling edge 104 is received in the female coupling edge 103, the seal 117 is compressed to form a leak tight sealing.

FIGS. 5A and 5B show an alternative embodiment comprising a pair of building panels, in particular roof panels 141, 142 with matching coupling edges 143, 144. The two panels 141, 142 comprise a core 145 of an insulating material sandwiched between an outer cover sheet 146 forming the exterior roof surface, and an inner cover sheet 147 facing the roofed interior space.

The coupling edge 143 of the panel 141 shown left in the drawing is a female coupling edge, while the coupling edge 144 of the other panel 142 is a male coupling edge. The cross section shown in FIGS. 3A and 3B is substantially constant over the length of the coupling edges 143, 144.

The cover sheets 146, 147 of both panels 141, 142 have sheet edges, which are bent inwardly (i.e., towards a center face X' of the panel 141, 142) to form projections 148A, 148B, 149A, 149B extending substantially parallel to the outer surfaces of the cover sheets 146, 147 of the panels 141, 142.

The female coupling edge 143 of the left panel 141 comprises the two projections 148A, 148B and a coupling recess 151 between the two projections 148A, 148B. The coupling recess 151 comprises a compressible foam backbone 152 between the two projections 148A, 148B and extending over the full length of the coupling edge 143. The projections 148A, 148B are offset from the rest of the respective cover sheets 146, 147 to define receiving recesses 153, 154 for receiving the respective projections 149A, 149B of the male coupling edge 144, in such a manner that the outer coversheets 146 of the two panels 141, 142 are flush with each other, just as the inner cover sheets 147.

The male coupling edge 144 comprises the projections 149A, 149B, a middle protrusion 155, a first recess 156 between the projection 149A and the middle protrusion 155, and a second recess 157 between the projection 149B and the middle protrusion 155. The first recess 156 is configured to receive the projection 148A of the female coupling edge 143. The second recess 157 is configured to receive the projection 148B of the female coupling edge 143. The middle protrusion 155 of the male coupling edge 143 forms a tight clamping fit with the coupling recess 151 of the female coupling edge 144.

At the male coupling edge 143, the sheet edge of the outer cover sheet is bent inwardly with a U-turn to form the projection 149A. At the root of this projection 149A, the sheet edge is again bent inward to define a broadest width of the first recess 156 which is larger than the width of the received projection 148A. Then, the sheet edge is bent back to an outer end of the middle protrusion 155 at an inclination angle such that the width of the first recess 156 between the tips of the middle protrusion 155 and the projection 149A is less than the broadest width. When the two panels 141, 142 are mated, the projection 148A fits in the narrower opening of the first recess 156, but at the broader part of the first recess 156 a first water discharge channel 158 is defined between the projection 148A of the female coupling edge 143 and the middle protrusion 155 of the male coupling edge 144.

The projection 148A extending from the outer cover sheet 146 of the female coupling edge 143 has a root section 159 and a receding tip 160. When mated, the root section 159 engages the tip of the projection 149A while the receding tip 160 is spaced from the projection 149A of the male coupling edge 144. In this position the receding tip 160 and the projection 149A jointly define a seal receiving recess 161. A seal 162 is received in the seal receiving recess 161.

In the second recess 157 of the male coupling edge 143, the projection 148B has a substantially flat surface. The projection 149B has a concave or kinked surface facing the projection 148A to form a concavity 163. When the two coupling edges 143, 144 are mated, this concavity 163 and the projection 148B of the female coupling edge 144 jointly enclose a second water discharge channel 164 running along the length of the coupling edges 143, 144.

Rain water or melting snow seeping into the coupling is primarily blocked by the seal 162. Water that still passes the seal 162 is collected and discharged in the first water discharge channel 158. If part of the water still leaks through, it is collected and discharged via the second water discharge channel 164.

The disclosure is not restricted to the above described embodiments which can be varied in a number of ways within the scope of the claims.

The invention claimed is:

1. A roof structure comprising building panels and a coupling system for coupling the building panels, the building panels comprising two cover sheets including an inner cover sheet and an outer cover sheet, and a core of insulating material sandwiched between the two cover sheets;

wherein the building panels are mounted side by side on a roof support, the building panels having matching coupling edges, the coupling edges are inclined extending from one or both sides of a roof ridge of the roof structure to respective lower edges of the roof structure, the coupling edges are profiled to define one or more water discharge channels running substantially parallel to the coupling edges, the coupling system comprises one or more compressible seals between the coupling edges at a position between the one or more water discharge channels and the outer cover sheet, and wherein, the cover sheets have bent sheet edges at the coupling edges, the bent sheet edges extending into the core of the insulating material, the coupling edge of one of the building panels is a female coupling edge recessed between the bent sheet edges, and the female coupling edge is offset from an exterior surface of the building panel, the coupling edge of another said building panel is a male coupling edge with the bent sheet edges being offset from outer surfaces of the building panel, so as to form a coupling projection fitting within a coupling recess of the female coupling edge, the male coupling edge comprises a flange extending to the outer surfaces of the building panel with the male coupling edge, and overlapping the female coupling edge so as to be flush with outer surface of the building panel with the female coupling edge, at least one of the male and female coupling edges is provided with at least one of the water discharge channels extending substantially parallel to the coupling edges, the water discharge channel is overlapped by the flange of the male coupling edge, and the water discharge channel is configured to receive a fastener in a sunk matter, the flange of the male coupling edge has a stepped cross section with an outer tip having a reduced thickness and a main part having an increased thickness, the main part overlapping the water discharge channel, the outer tip matching a recess in the female coupling edge and overlapping one of said one or more compressible seals, and one of the one or more compressible seals is a hollow strip or hose and comprises a compressible sealing strip compressed by an edge between the outer tip and the main part of the flange of the male coupling edge.

2. The roof structure according to claim 1, wherein one of the one or more compressible seals is partly received in a matching recess.

3. The roof structure according to claim 1, wherein at least one of the bent sheet edges of the female coupling edge is received in the matching recess in the male coupling edge, the matching recess being extended to form the water discharge channel.

4. The roof structure according to claim 3, wherein the matching recess of the female coupling edge within the water discharge channel is adjacent to the flange of the male coupling edge.

* * * * *